US007380503B2

(12) United States Patent
Williams et al.

(10) Patent No.: US 7,380,503 B2
(45) Date of Patent: Jun. 3, 2008

(54) METHOD AND APPARATUS FOR SELF-DESTRUCT FRANGIBLE PROJECTILES

(75) Inventors: Keith T. Williams, Edgefield, SC (US); Michael Maston, Oak Ridge, TN (US); Scott Martin, Oro Valley, AZ (US)

(73) Assignee: Newtec Services Group, Edgefield, SC (US)

( * ) Notice: Subject to any disclaimer, the term of this patent is extended or adjusted under 35 U.S.C. 154(b) by 312 days.

(21) Appl. No.: 11/017,430

(22) Filed: Dec. 20, 2004

(65) Prior Publication Data

US 2006/0144281 A1 Jul. 6, 2006

(51) Int. Cl.
*F42B 12/06* (2006.01)
*F42B 12/22* (2006.01)

(52) U.S. Cl. ..... 102/518; 102/519; 102/506

(58) Field of Classification Search ..... 102/506, 102/518, 517, 519, 520, 521, 522, 523
See application file for complete search history.

(56) References Cited

U.S. PATENT DOCUMENTS

| | | | | |
|---|---|---|---|---|
| 4,216,722 | A | 8/1980 | Angell | |
| 4,836,108 | A * | 6/1989 | Kegel et al. | 102/306 |
| 4,970,960 | A * | 11/1990 | Feldmann | 102/506 |
| 5,148,750 | A * | 9/1992 | Becker et al. | 102/439 |
| 5,237,930 | A | 8/1993 | Belanger et al. | |
| 5,656,792 | A * | 8/1997 | Rentzsch et al. | 102/489 |
| 5,717,159 | A | 2/1998 | Dixon et al. | |
| 5,760,331 | A | 6/1998 | Lowden | |
| 5,763,819 | A | 6/1998 | Huffman | |
| 5,767,438 | A | 6/1998 | Lang et al. | |
| 5,852,255 | A | 12/1998 | Hallis et al. | |
| 5,852,858 | A | 12/1998 | Hallis et al. | |
| 5,913,256 | A | 6/1999 | Lowden et al. | |
| 5,963,776 | A | 10/1999 | Lowden et al. | |
| 6,024,021 | A | 2/2000 | Schultz | |
| 6,090,178 | A | 7/2000 | Benini | |
| 6,115,894 | A * | 9/2000 | Huffman | 86/55 |
| 6,135,028 | A * | 10/2000 | Kuhns et al. | 102/499 |
| 6,149,705 | A | 11/2000 | Lowden et al. | |
| 6,174,494 | B1 | 1/2001 | Lowden et al. | |
| 6,248,150 | B1 | 6/2001 | Amick | |

(Continued)

OTHER PUBLICATIONS

"Nanoenergetics: An Emerging Technology Area of National Importance", by Dr. Andrzej W. Miziolek, The AMPTIAC Newsletter, Spring 2002, vol. 6, No. 1; pp. 43-48 & 67.

(Continued)

*Primary Examiner*—James S Bergin
(74) *Attorney, Agent, or Firm*—Dority & Manning, P.A.

(57) ABSTRACT

The present invention discloses and claims an apparatus and method for delivering a wide array of selected agents to a target from stand-off distances. The apparatus includes a self-destruct frangible projectile made of primary, binding, and active components. The primary component generally has a specific gravity greater than lead, and the binding component generally has a specific gravity less than lead. The active component may be a metal for penetrating the target, a dye for optically marking the target, or another specially selected agent for delivery to the target, depending on the particular embodiment. The frangible projectile self-destructs upon contact with the target, in proximity to the target, or after passing the target, depending on the particular embodiment.

20 Claims, 9 Drawing Sheets

U.S. PATENT DOCUMENTS

| | | | |
|---|---|---|---|
| 6,263,798 | B1 | 7/2001 | Benini |
| 6,308,607 | B1 | 10/2001 | Woodall et al. |
| 6,317,946 | B1 | 11/2001 | Beal |
| 6,546,838 | B2 | 4/2003 | Zavitsanos et al. |
| 6,546,875 | B2 | 4/2003 | Vaughn et al. |
| 6,629,485 | B2 | 10/2003 | Vaughn et al. |
| 6,679,176 | B1 | 1/2004 | Zavitsanos et al. |
| 6,691,622 | B2 | 2/2004 | Zavitsanos et al. |
| 6,722,283 | B1 | 4/2004 | Dindl et al. |
| 6,749,802 | B2 | 6/2004 | Amick |
| 6,799,518 | B1 | 10/2004 | Williams |
| 6,823,798 | B2 | 11/2004 | Amick |
| 6,935,217 | B2 | 8/2005 | Beal |
| 2002/0005137 | A1 | 1/2002 | Stone |
| 2002/0174794 | A1 | 11/2002 | Lowden et al. |
| 2003/0167956 | A1* | 9/2003 | Kellner ..... 102/517 |
| 2004/0216589 | A1 | 11/2004 | Amick |
| 2005/0034592 | A1 | 2/2005 | Beal |
| 2005/0188790 | A1 | 9/2005 | Amick |
| 2005/0188886 | A1 | 9/2005 | Vasal et al. |
| 2005/0188889 | A1 | 9/2005 | Machina et al. |
| 2005/0188890 | A1 | 9/2005 | Tarrant |

OTHER PUBLICATIONS

"Synthesis and Reactivity of a Super-Reactive Metastable Intermolecular Composite Formulation f A1/$KMnO_4$", by Anand Prakash, Alon V. McCormick and Michael R. Zachariah, Adv. Mater 2005, 17, No. 7, Apr. 4.

* cited by examiner

METHOD AND APPARATUS FOR SELF-DESTRUCT FRANGIBLE PROJECTILES

BACKGROUND OF THE INVENTION

The present invention relates generally to self-destruct frangible projectiles for delivering a wide array of selected agents to a target from stand-off distances.

Various devices and methods exist to deliver a selected agent to a target at limited distances with limited penetration of the target. For example, a tear gas gun or rifle can deliver a canister containing an agent to a target. However, these specialized, single-purpose instruments are limited to delivering only similarly specialized, single-purpose canisters, and the specialized, single-purpose canisters contain a limited number of agents, such as CS2 or pepper spray. In addition, after dispersing the selected agent to the target, the discharged canister typically remains at the target and is therefore readily observable. Moreover, the canister's ballistic characteristics and structure necessarily limit the maximum effective range and penetrating capability for the canister.

Other devices and methods are capable of longer ranges and greater penetration using virtually any caliber of weapon. For example, U.S. Pat. No. 6,263,798 issued to Benini and U.S. Pat. Nos. 5,852,255 and 5,852,858 issued to Hallis et al describe frangible bullets designed to break apart with little or no penetration of the target. U.S. Pat. No. 6,024,021 issued to Schultz and U.S. Pat. No. 6,115,894 issued to Huffman describe frangible bullets that include one or more rods. In these designs, the frangible bullet penetrates the target before or during franging to allow the rods to continue along the delivery path and further penetrate the target.

Although the frangible bullets described above provide additional range and penetrating capability, none of these frangible bullets is capable of delivering a wide array of selectable materials, blended materials, or agents to the target. In addition, these frangible bullets rely on impact with the target to break the bullet apart and release the particular agent. As a result, these frangible bullets provide no capability for dispersing the selected agent without requiring an impact with the target. Furthermore, in the event these frangible bullets miss the target, the bullet continues along its trajectory creating a fall of shot hazard to downrange objects.

As a result, the need exists for an improved frangible projectile capable of delivering a wide array of selectable materials, blended materials, or agents to the target without requiring impact with the target or creating a downrange hazard in the event the frangible projectile misses the intended target.

SUMMARY OF THE INVENTION

Objects and advantages of the invention are set forth below in the following description, or may be obvious from the description, or may be learned through practice of the invention.

In one embodiment of the present invention, a self-destruct frangible projectile for marking a target of interest may include a ballistic shape having a front end, a distal end, and a longitudinal bore in the distal end. The ballistic shape may include a primary component having a specific gravity greater than lead and a binding component having a specific gravity less than lead. The primary and binding components may be cold-pressed together to form the ballistic shape. The self-destruct frangible projectile may further include an optical marker in the longitudinal bore of the ballistic shape, and the optical marker may have at least one predetermined wavelength. An explosive charge may be proximate to the optical marker, and a detonator may be operatively connected with the explosive charge to ignite the explosive charge. The primary component may comprise at least one of tungsten, tantalum, or tungsten-carbide, and the binding component may comprise at least one of tin, aluminum, bismuth, copper, zinc, nylon, or polytetrafluoroethylene.

In particular embodiments, the primary component may comprise particles having a diameter between approximately 0.001 and 0.040 inches. In other particular embodiments, the self-destruct frangible projectile may have a specific gravity approximately equal to lead. The self-destruct frangible projectile may further include a retainer cup in the longitudinal bore of the ballistic shape for receiving the explosive charge, and the detonator may include a timing mechanism for igniting the explosive charge at a predetermined time, distance, or rotation of travel of the frangible projectile.

In another embodiment of the present invention, a self-destruct frangible projectile for marking a target of interest may include a ballistic shape having a front end, a distal end, and a longitudinal bore in the distal end. The ballistic shape may include a primary component having a specific gravity greater than lead, a binding component having a specific gravity less than lead, and an optical marker having at least one predetermined wavelength. The primary component, binding component, and optical marker may be cold-pressed together to form the ballistic shape. In particular embodiments, the optical marker may be substantially homogeneously mixed with the primary and binding components.

The present invention further includes a method for marking a target of interest. The method may include cold-pressing a primary component, a binding component, and an optical marker to create a frangible projectile. The primary component may have a specific gravity greater than lead, and the binding component may have a specific gravity less than lead. The optical marker may have a predetermined wavelength. The method may further include inserting an explosive charge into the frangible projectile and connecting a detonator to the explosive charge for igniting the explosive charge. The frangible projectile may be assembled into a ballistic cartridge, and the frangible projectile may be fired from the ballistic cartridge at the target of interest. The method may also include igniting the explosive charge to break up the frangible projectile proximate to the target of interest to release the optical marker and disperse the optical marker on the target of interest. Particular embodiments may further include exciting the optical marker.

Another embodiment of the present invention may be a self-destruct frangible projectile having a ballistic shape with a front end, a distal end, and a longitudinal bore in the distal end. The ballistic shape may include a primary component having a specific gravity greater than lead and a binding component having a specific gravity less than lead. The primary and binding components may be cold-pressed together to form the ballistic shape. The self-destruct frangible projectile may further include a penetrator in the longitudinal bore of the ballistic shape. An explosive charge may be proximate to the penetrator, and a detonator may be operatively connected with the explosive charge to ignite the explosive charge.

In particular embodiments, the penetrator may comprise a plurality of washers, and at least some of the washers may be directly flush with one another. In other particular embodiments, the self-destruct frangible projectile may further include a full-metal jacket surrounding the front end of the ballistic shape. Other particular embodiments may further include a nose-piece proximate the front end of the ballistic shape.

In another embodiment of the present invention, a self-destruct frangible projectile may include a ballistic shape having a front end, a distal end, and a longitudinal bore in the distal end. The ballistic shape may include a primary component having a specific gravity greater than lead, a binding component having a specific gravity less than lead, and a penetrator. The primary component, binding component, and penetrator may be cold-pressed together to form the ballistic shape.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
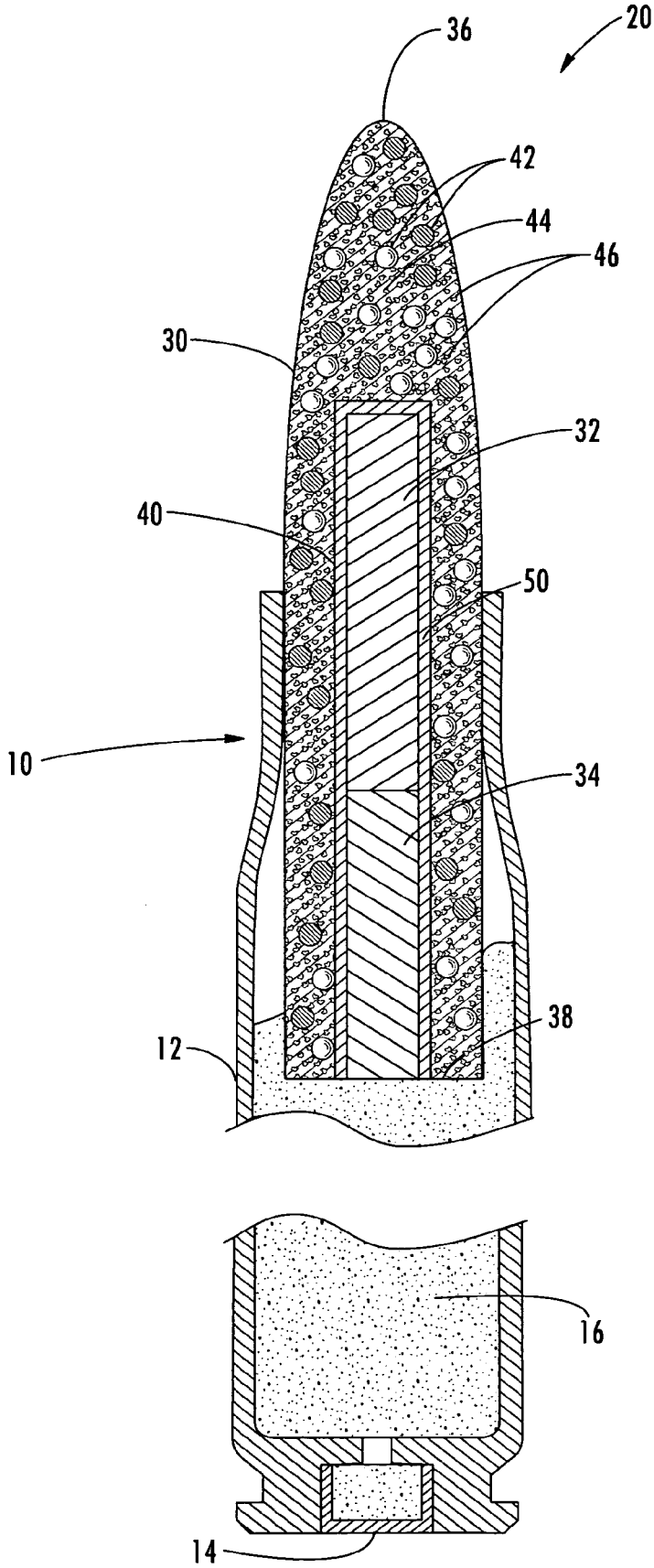
FIG. 1 is a side plan view of an embodiment of the present invention.

Repeat use of reference characters in the present specification and drawings is intended to represent the same or analogous features or elements of embodiments of the invention.

DETAILED DESCRIPTION

Reference will now be made in detail to present embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The devices and methods of the present invention are compatible for use with conventional small and large caliber firearms, as well as with larger delivery platforms such as those used in the military, for delivering a wide array of selected agents to a target from stand-off distances. Examples of selected agents include dyes, chemicals, diatomaceous earths, reactants, ceramics, metals, powders, polymers, mixtures, compounds, and other basic elements of the periodic table, depending on the particular application.

FIG. 1 illustrates an unjacketed center-fired cartridge 10 containing a self-destruct frangible projectile 20 constructed according to one embodiment of the present invention. The cartridge 10 generally includes a casing 12, primer 14, propellant 16, and the self-destruct frangible projectile 20. The casing 12, primer 14, and propellant 16 are typical components common to center-fired cartridges known in the art. The self-destruct frangible projectile 20 may have a specific gravity approximately equal to lead, making the projectile compatible with commercially available propellants, yet the projectile is sufficiently hard to withstand firing transients caused by the propellant 16. In other embodiments, the self-destruct frangible projectile 20 may have a specific gravity greater than or less than lead, depending on the particular application, environment, and needs. It should be understood by one of ordinary skill in the art that the present invention includes use of the self-destruct frangible projectile 20 in a full-jacketed cartridge as well as in a rim-fired cartridge (not shown) which would be substantially identical to the center-fired cartridge, except for the absence of the primer 14.

In operation, a user chambers the cartridge 10 containing the self-destruct frangible projectile 20 in a weapon suited for the caliber of the cartridge 10. A sabot (not shown) may encase the cartridge 10 to adapt a smaller caliber cartridge for use in a larger caliber weapon. A firing pin in the weapon strikes the primer 14 to ignite the propellant 16 in the casing 12 and propel the self-destruct frangible projectile 20 from the casing 12 out of the weapon toward the intended target. If a sabot is used, a portion of the sabot may remain around the casing 12 in the chamber of the weapon, while the remainder of the sabot falls away from the self-destruct frangible projectile 20 shortly after exiting the weapon.

As illustrated in the embodiment shown in FIG. 1, the self-destruct frangible projectile 20 generally comprises a ballistic shape 30 having an explosive charge 32 and a detonator 34 to provide the self-destruct capability of the invention. As shown, the ballistic shape 30 generally includes a front end 36, a distal end 38, and a longitudinal bore 40. The ballistic shape 30 comprises a primary component 42, a binding component 44, and an active component 46.

The primary component 42 provides the majority of the density for the ballistic shape 30. The primary component 42 may be a metal and/or a metal compound or alloy generally having a specific gravity greater than lead. Before fabrication into the ballistic shape, the primary component 42 generally consists of a powder of small particles having a diameter on the order of 25-1,000 μm (approximately 0.001-0.040 inches), although smaller or larger particles are within the scope of the present invention. Suitable elements for the primary component 42 may be tungsten, tantalum, and/or compounds or alloys made from these materials such as tungsten-carbide, although other suitable elements are known to one of ordinary skill in the art and within the scope of the present invention.

The binding component 44 is relatively light and soft compared to the primary component 42 and binds the components together to form the geometry of the ballistic shape 30. The binding component 44 generally has a specific gravity less than lead. Suitable elements for the binding component 44 may be tin, aluminum, bismuth, copper, zinc, nylon, polytetrafluoroethylene (PTFE), and/or compounds or alloys made from these materials, although other suitable elements are known to one of ordinary skill in the art and within the scope of the present invention.

The active component 46 consists of the selected agents to be delivered to the target by the self-destruct frangible projectile 20, depending on the particular application for the self-destruct frangible projectile 20. For example, the active component 46 may comprise a metal to penetrate the target or a dye to mark the target, the particulars of which will be described in more detail later. Alternate embodiments within the scope of the present invention may employ a polymer or other reactive chemical agent as the active component 46 to react with a target containing a fluid. As the projectile disperses the polymer or other reactive chemical agent over the target containing the fluid, the polymer or other reactive chemical agent coagulates the fluid into a more solid or gelled form to minimize the potential for airborne contamination and facilitate subsequent safe handling and disposal. Another embodiment within the scope of the present invention may employ a micron, sub-micron, or nano-powder as the active component 46 to reduce friction and scavenge air or oxygen for use with a target having an explosive capability. Examples of suitable micron, sub-micron, or nano-powders include silicone, silica dioxide, silicon carbide, titanium carbide, aluminum nitride, aluminum oxide, titanium dioxide, carbon, boron, aluminum, magnesium, iron, sulfur, or zirconium, although other suitable agents are known to one of ordinary skill in the art and within the scope of the present invention. These examples of active components provide illustrations of specific embodiments and are not intended to limit the scope of the invention to the specific embodiments.

Figure 2:
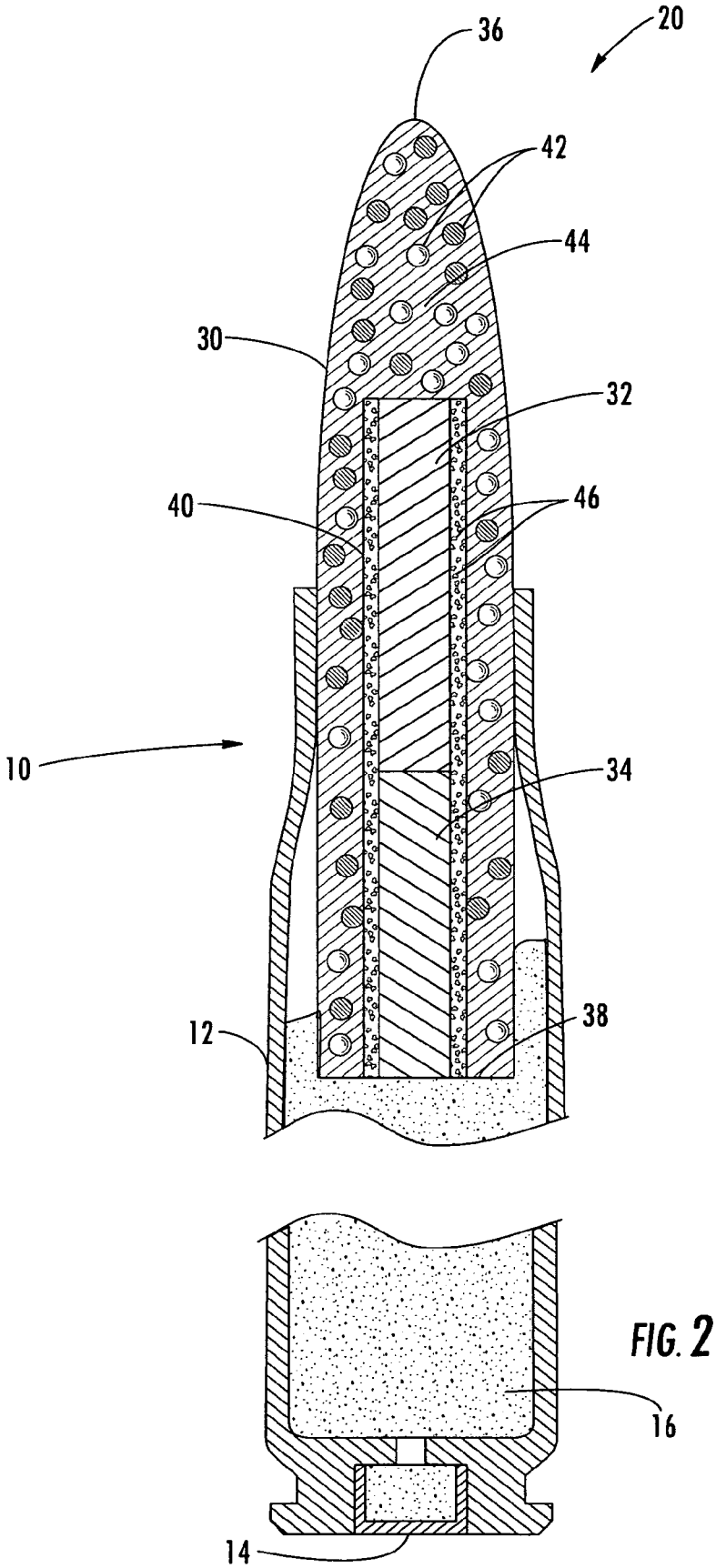
FIG. 2 is a side plan view of an alternate embodiment of the present invention.

As shown in FIG. 1, the active component 46 may exist as part of a homogeneous mixture with the primary 42 and binding 44 components. In this embodiment, the primary 42, binding 44, and active 46 components adhere together to form the ballistic shape 30 using cold (i.e., room temperature or slightly heated) pressure or swaging. This method of fabrication is well known to one of ordinary skill in the art and is fully described in U.S. Pat. No. 5,963,776 issued to Lowden et al, incorporated herein by reference in its entirety for all purposes. Alternately, the active component 46 may reside separately from the primary 42 and binding 44 components, in pockets, cavities, or the longitudinal bore 40, as shown in FIG. 2.

The amount of pressure used in the cold swaging process may vary according to the particular target, barriers around the target, and intended use for the self-destruct frangible projectile 20. For example, the fabrication pressure may be on the order of 350 MPa, or greater, if the self-destruct frangible projectile 20 must penetrate a hard target, such as ⅜ inch carbon steel, before franging. Alternately, the fabrication pressure may be on the order of 140 MPa, or less, if the frangible projectile 20 must break up immediately upon impact with a relatively soft target, such as 1/32 inch sheet-metal. These examples are by way of illustration only and are not intended to limit the scope or meaning of the present invention. Regardless of the fabrication pressure, the explosive charge 32 ensures substantially complete break up of the projectile into its constituent components, with or without impact with the target.

The longitudinal bore 40 provides a cavity in the ballistic shape 30 for containing the active component 46 and/or the explosive charge 32 and detonator 34. The longitudinal bore 40 may be drilled or machined into the distal end 38 of the ballistic shape 30 after fabrication. Alternately, the longitudinal bore 40 may be formed using an appropriate die during the cold swaging fabrication.

The particular size, shape, and volume of the longitudinal bore 40 varies according to several variables, such as the cold swaging fabrication pressure, the size of the ballistic shape 30, the volume required for the active component 46 and/or the explosive charge 32 and detonator 34, and the volume required for any additional material to be contained therein. For example, a higher fabrication pressure for the ballistic shape 30 may require a corresponding larger volume for the longitudinal bore 40 to contain sufficient explosive charge 32 to ensure sufficient break up of the ballistic shape 30. Conversely, a smaller volume for the longitudinal bore 40 may be suitable where the active component 46 is mixed with the primary 42 and binding 44 components during fabrication, thus requiring only sufficient volume to contain the explosive charge 32 and detonator 34. One of ordinary skill in the art can determine a suitable size, shape, and volume for the longitudinal bore 40 based on minimal experimentation.

The explosive charge 32 and detonator 34 provide the self-destruct capability of the frangible projectile 20. The explosive charge 32 ensures a substantially complete break up of the ballistic shape 30 into its constituent components. The explosive charge 32 may comprise any explosive powder, chemical, paste, or gas having sufficient destructive power to break apart the ballistic shape 30 into its constituent components. Examples of suitable explosive charges include gun powder, trinitrotoluene (TNT), ammonium nitrate, amatol, trinitromethylbenzene, hexanitrobenzene, composite explosives such as C3 and C4, hydrogen, or other explosives available and known to one of ordinary skill in the art.

The detonator 34 is operatively connected to the explosive charge 32 to ignite the explosive charge 32. As such, the detonator 34 provides the desired delay between firing the cartridge 10 and ignition of the explosive charge 32. In some embodiments, the ignition may occur when the ballistic shape 30 reaches the intended target to disperse the active component 46 over the target. In other embodiments, the ignition may occur after the ballistic shape 30 passes the intended target to break apart the ballistic shape 30 before it reaches other downrange objects.

The detonator 34 may comprise any suitable electric or pyrotechnic device known in the art for providing a reliable delay between firing the cartridge 10 and ignition of the explosive charge 32. This delay between firing and ignition may be based on any reliable and measurable parameter, such as time of travel, distance of travel, or rotation of the projectile. For example, the detonator 34 may comprise a programmable fuse, a train fuse, a breach fuse, a muzzle fuse, an infrared activated fuse, or a rotational fuse, to name a few.

The explosive charge 32 and detonator 34 reside in the longitudinal bore 40. In particular embodiments, such as is illustrated in FIG. 1, the longitudinal bore 40 may include a retainer cup 50 to contain the explosive charge 32 and/or detonator 34. As such, the retainer cup 50 allows the explosive charge 32 and/or detonator 34 to be separately manufactured and assembled for subsequent installation into the longitudinal bore 40.

Figure 3A:
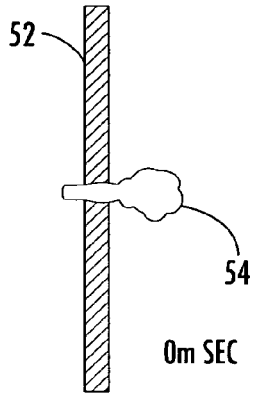
FIGS. 3A, 3B, 3C, and 3D are sequential views of an embodiment of the present invention passing through a target.
Figure 3B:
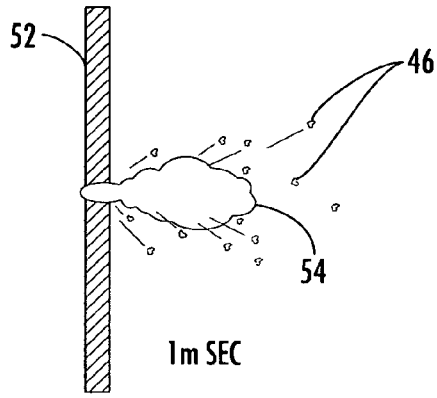
Figure 3C:
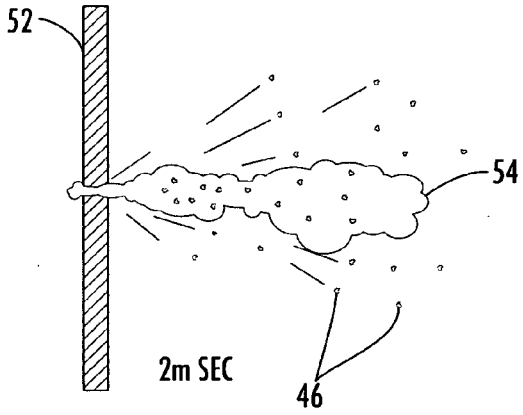
Figure 3D:
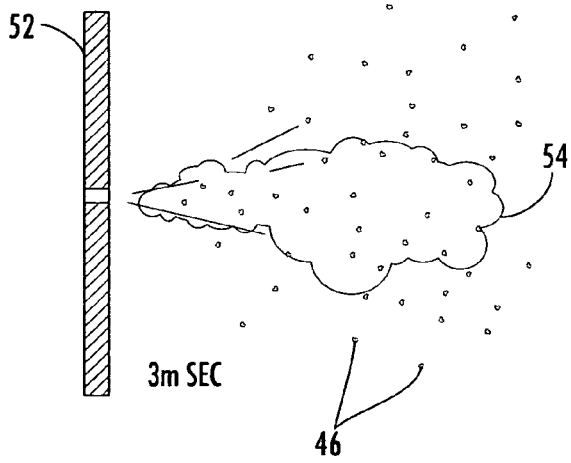

FIGS. 3A, 3B, 3C, and 3D illustrate snapshot depictions at 1 millisecond intervals of one embodiment of the self-destruct frangible projectile 20 fired through an 18 gauge steel panel 52. The fabrication pressure for this embodiment may be approximately 240 MPa to ensure that the frangible projectile 20 penetrates the steel panel 52 before franging. As shown in FIG. 3A, the frangible projectile 20 penetrates most or all of the steel panel 52 before beginning to break apart. FIG. 3B shows that as the frangible projectile 20 passes through the steel panel 52, the projectile 20 completely disintegrates to form a cloud 54 of primary and binding components while releasing the active component 46 in the target area. Subsequent snapshots, FIGS. 3C and 3D, illustrate that the cloud 54 continues to expand along the axis of travel, further dispersing the active component 46 in the target area. For this particular illustration, the self-destruct feature of the frangible projectile would ensure complete disintegration of the projectile either after the initial break up or in the event the projectile missed the intended target.

Figure 4:
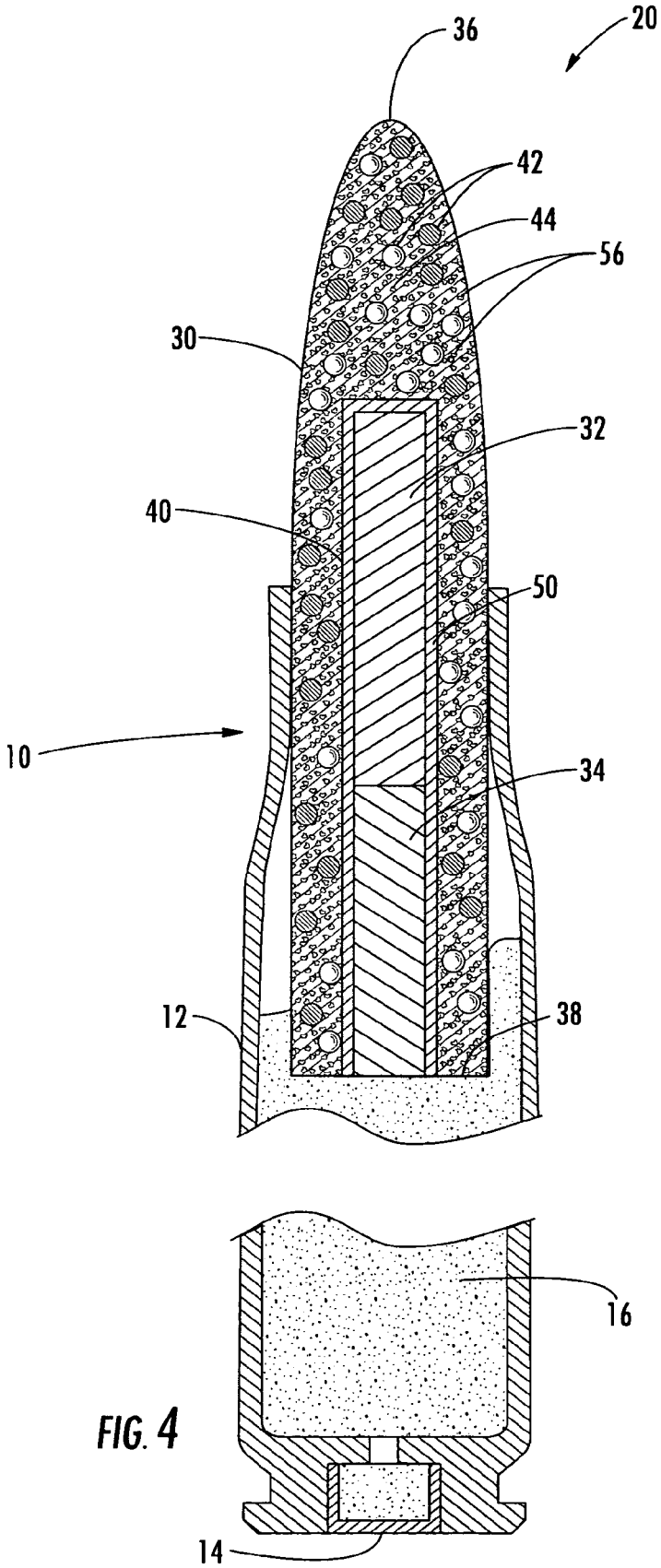
FIG. 4 is a side plan view of an alternate embodiment of the present invention for marking a target.

Particular embodiments of the present invention will now be described. The particular embodiment shown in FIG. 4 is analogous to the embodiment previously described with respect to FIG. 1, except that the self-destruct frangible projectile 20 includes an optical marker 56 as the active component 46. The optical marker 56 enables a user to mark, detect, monitor, track, and/or identify a target of interest at significant distances. Examples of a suitable optical marker 56 are fluorescent or optical powders such as fluoroscene and rhodamine liquid dyes; phosphors and phosphorus powders; diatomaceous earths that include different sub-micron size silica crystals, yttrium, or europium; powdered minerals, such as garnet and sapphire, that emit a specific wave length signature in one of the light wave spectrums, to include ultraviolet, visible, infrared, x-ray; or a blend of the preceding optical powders for a multi-spectral wavelength signature in one or more of the light wave spectrums, although other suitable elements are known to one of ordinary skill in the art and within the scope of the present invention. The optical marker 56 may emit a fluorescent response with a specific or multi-spectral wavelength signature that can be viewed in the visible light spectrum or detected by sensors in the invisible ultraviolet, infrared, and x-ray electromagnetic spectrums.

In this particular embodiment, penetration of or even contact with the target by the projectile 20 may not be necessary or desirable. Therefore, the fabrication pressure for the frangible projectile 20 containing the optical marker 56 may be the minimum cold swaging pressure necessary to ensure structural integrity of the projectile 20 from firing, through the ballistic trajectory, until either impact with the target or ignition of the explosive charge 32.

Figures 5A, 5B, 5C:
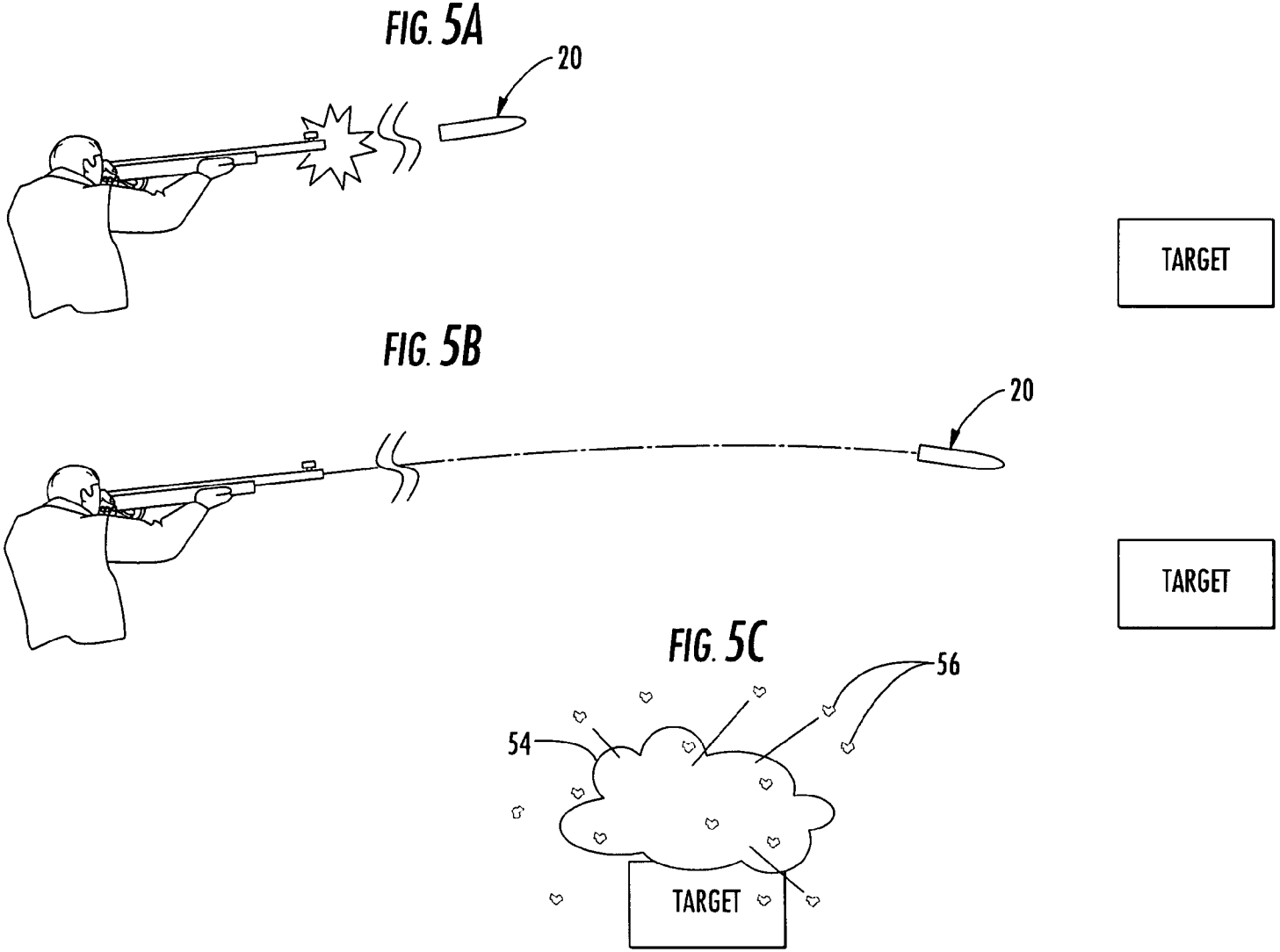
FIGS. 5A, 5B, and 5C show the use of the embodiment illustrated in FIG. 4.

The embodiment shown in FIG. 4 provides a device and method for marking, detecting, monitoring, tracking, and/or identifying a target of interest at significant distances without requiring that the frangible projectile 20 impact the target. For example, as shown in FIGS. 5A and 5B, a user can fire the self-destruct frangible projectile 20 containing the optical marker 56 at the desired target. Once near the target, the detonator 34 ignites the explosive charge 32 to break up the ballistic shape 30 to release and disperse the optical marker 56 on the target, as shown in FIG. 5C.

Once marked, a light source such as a Laser Induced Fluorescent Imaging (LIFI) system may be used to excite the optical marker 56 in the ultraviolet, infrared, or visible light regions of the electromagnetic spectrum with a specific wavelength that yields excitation of the optical marker 56. The optical marker 56 generates a photon emission that is detectable by a sensor in the invisible regions of the electromagnetic spectrum or becomes visible to the human eye if the fluorescence is emitted in the visible light spectrum. A suitable detector may then be used to detect, monitor, track, and/or identify the marked target based on the specific wavelength emission of the marker or multi-spectral wavelengths emitted by the fluorescence of multiple blended optical materials.

Figure 6:
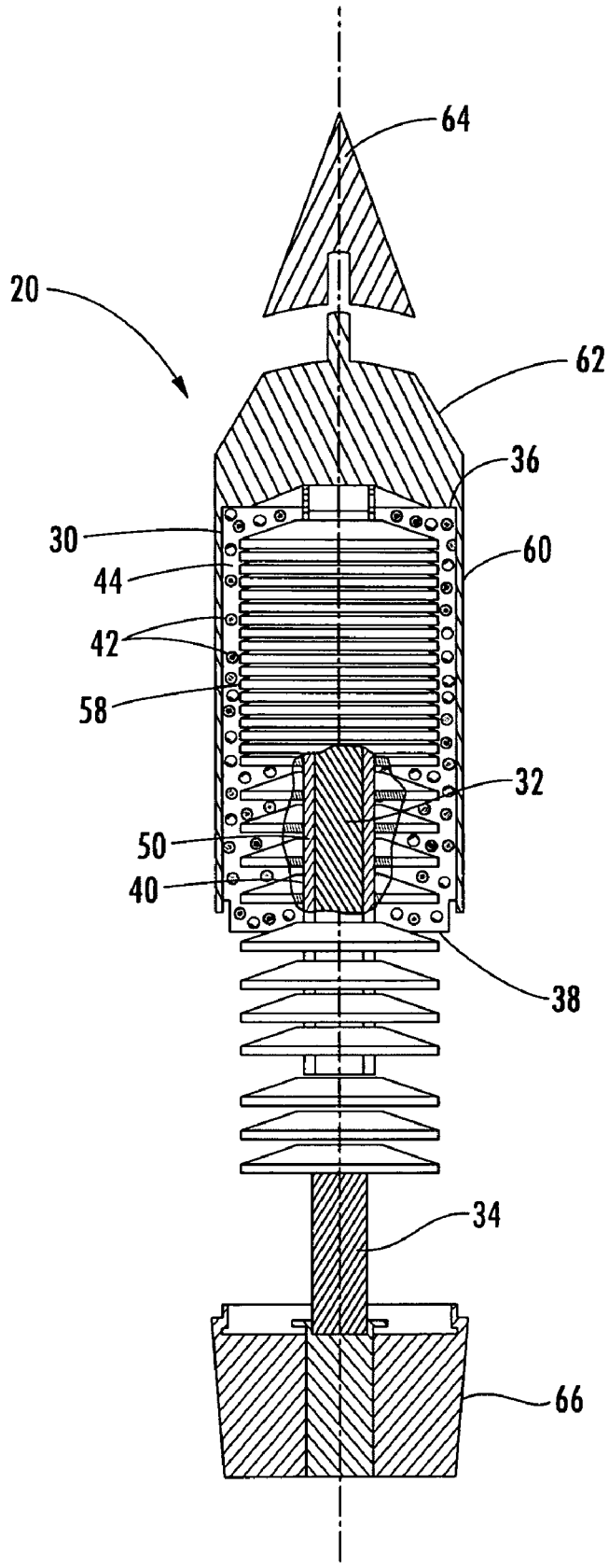
FIG. 6 is a partially exploded and partially cut-away side plan view of an alternate embodiment of the present invention.
Figure 7A:
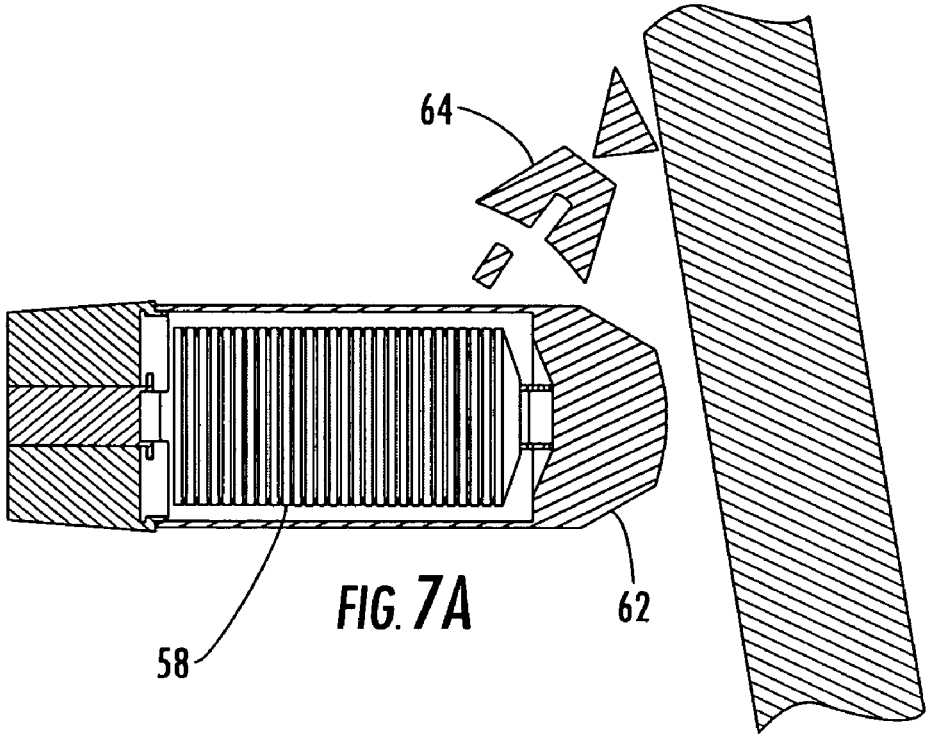
FIGS. 7A, 7B, 7C, and 7D are sequential side plan views of the embodiment illustrated in FIG. 6 impacting a target.
Figure 7B:
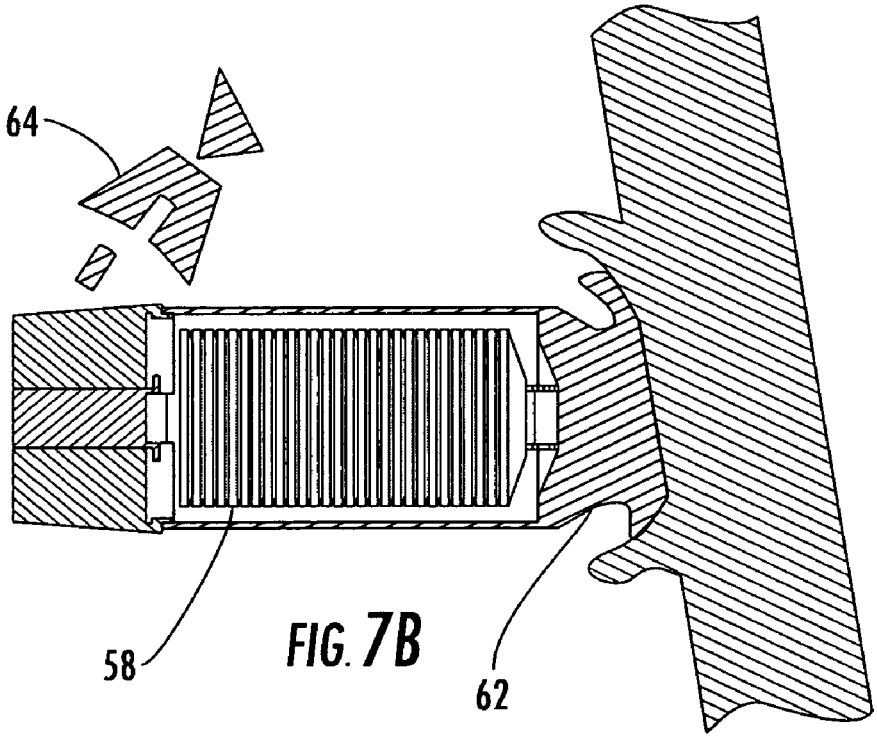
Figure 7C:
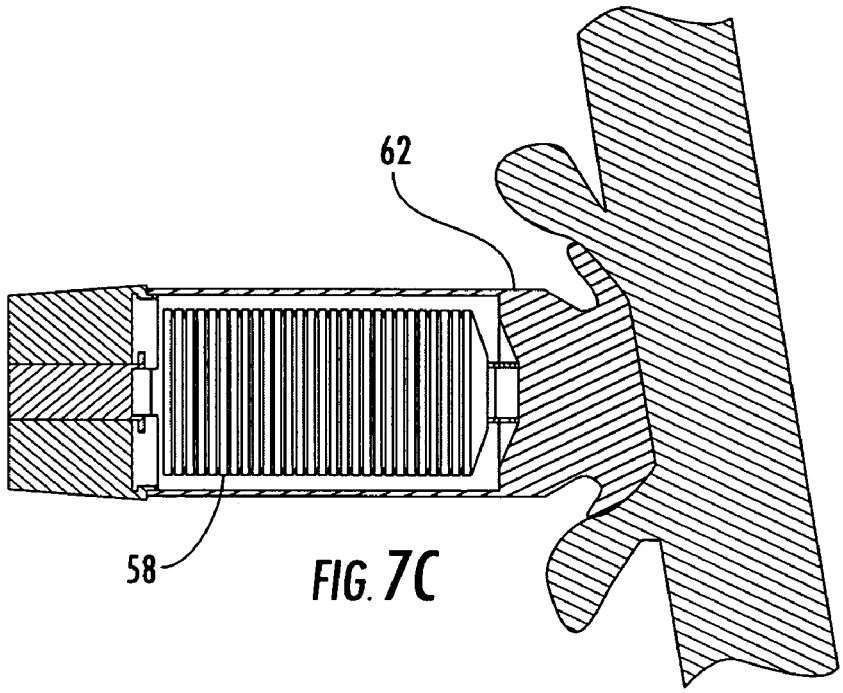
Figure 7D:
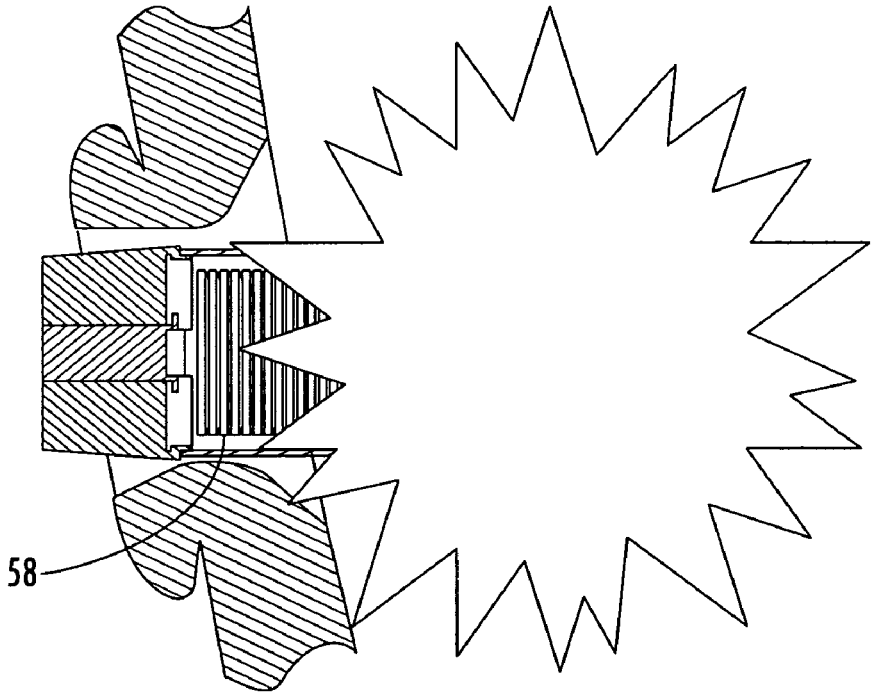
Figure 8A:
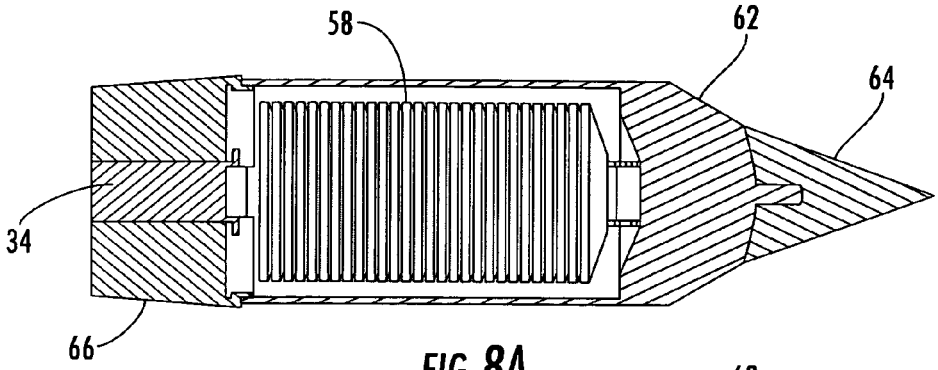
FIGS. 8A, 8B, 8C, and 8D are sequential side plan views of the embodiment illustrated in FIG. 6 as it self-destructs.
Figure 8B:
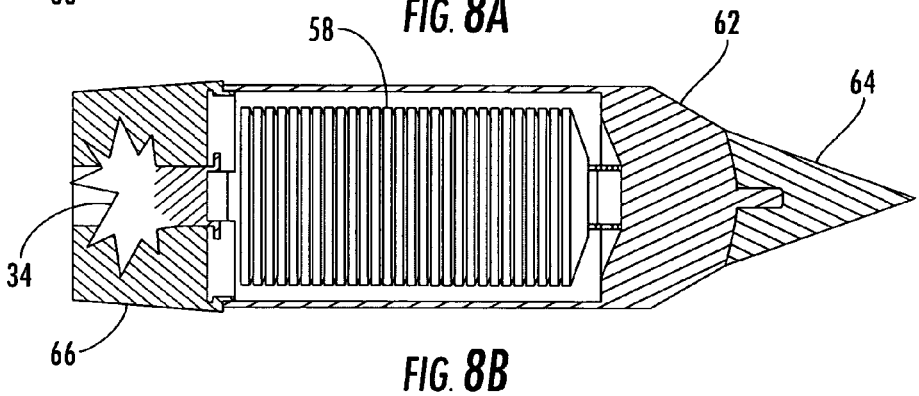
Figure 8C:
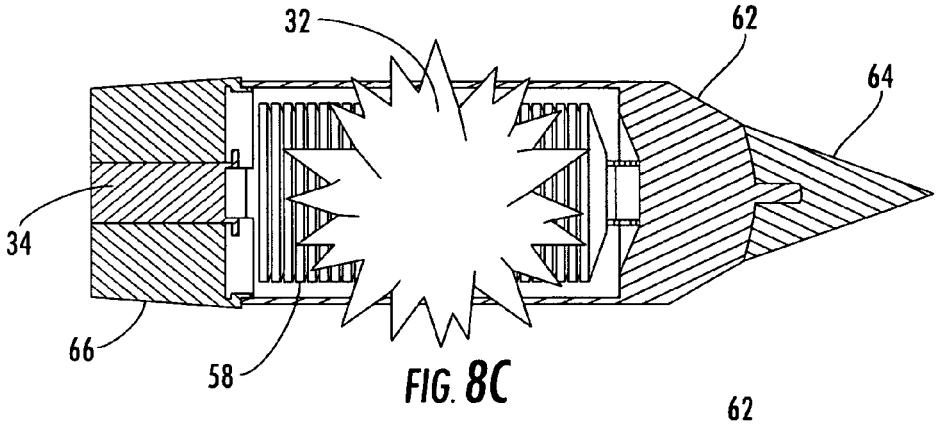
Figure 8D:
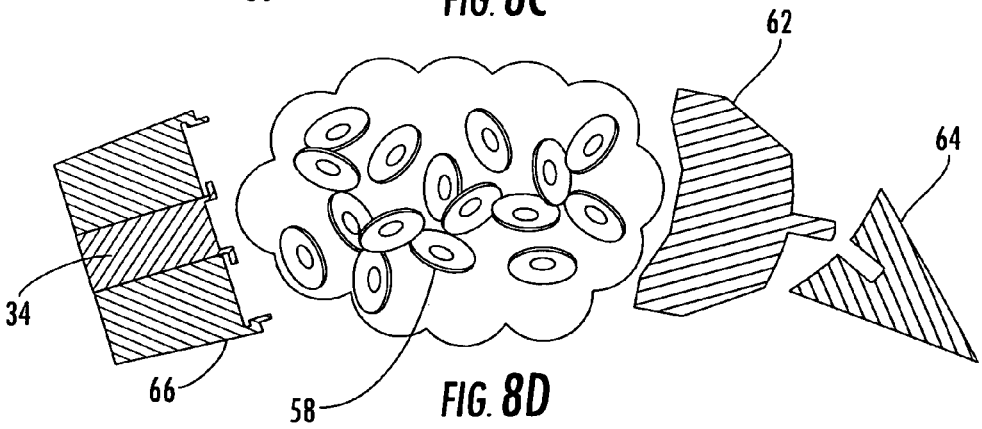

FIG. 6 illustrates another particular embodiment within the scope of the present invention. In this particular embodiment, the self-destruct frangible projectile 20 includes a penetrator 58 as the active component 46. This embodiment provides a device and method to hit and disrupt a target without creating a fall of shot hazard to downrange objects.

As shown in FIG. 6, this embodiment further includes a jacket 60, a nose piece 62, and front 64 and rear 66 stabilizing fins. Some or all of these additional features may be included in the embodiment, depending on the particular use.

The jacket 60 surrounds the ballistic shape 30 and protects it from premature fragmentation upon impact with the target. Examples of materials used for the jacket 60 include copper, aluminum, case-hardened steel, or other suitable casings known to one of ordinary skill in the art and within the scope of the present invention. The jacket 60 may include scoring at various points to enhance fragmentation of the jacket 60 upon ignition of the explosive charge 32.

The nose piece 62 provides a hardened tip at the front end 36 of the ballistic shape 30 for contacting and penetrating the intended target. Suitable elements for the nose piece 62 include case-hardened steel, tungsten, tantalum, and/or compounds or alloys made from these materials such as tungsten-carbide, although other suitable elements are known to one of ordinary skill in the art and within the scope of the present invention.

The front 64 and rear 66 stabilizing fins attach to the front 36 and distal 38 ends of the ballistic shape 30 to improve the ballistic characteristics of the self-destruct frangible projectile 20. Suitable material for the fins includes plastic and aluminum, although tungsten and case-hardened steel are harder materials that may be used, depending on the particular application.

The penetrator 58 may be any suitable material known by one of ordinary skill in the art for enhancing the ability of the frangible projectile 20 to penetrate and disrupt the intended target. Examples of suitable materials for the penetrator 58 include sintered, case-hardened, or cold-swaged steel, tungsten carbide, ceramics, or other similar materials. The penetrator 58 may comprise various articles, such as washers, discs, rods, balls, or other suitable geometries, depending on the particular use. The particular articles selected for the penetrator 58 may be configured so that they lie flush with adjacent articles. Alternately, the particular articles may include ridges, irregular surfaces, or other raised projections to ensure spacing between adjacent articles.

As previously described, the penetrator 58, as the active component, may be combined with the primary 42 and binding 44 components during the cold swaging fabrication to create the ballistic shape 30. Alternately, the primary 42 and binding 44 components may be pressed together to form the ballistic shape 30, and the penetrator 58 may be subsequently inserted into the longitudinal bore 40.

FIGS. 7A, 7B, 7C, and 7D provide sequential side plan views of the embodiment illustrated in FIG. 6 impacting a target. As shown, the front fin 64 breaks away upon initial impact with the target. The nose piece 62 then impacts and breeches the exterior of the target, allowing the penetrator 58 to further pierce and disable the target.

FIGS. 8A, 8B, 8C, and 8D provide sequential side plan views of the embodiment illustrated in FIG. 6 as it self-destructs. As shown, the detonator 34 ignites the explosive charge 32 to break up the frangible projectile 20 into its constituent components. Once broken up, the aerodynamic properties of the constituent components are greatly reduced. This causes the constituent components to decelerate and reduces the fall of shot hazard to downrange objects.

It should be appreciated by those skilled in the art that modifications and variations can be made to the embodiments of the invention set forth herein without departing from the scope and spirit of the invention as set forth in the appended claims and their equivalents.

What is claimed is:

1. A self-destruct frangible projectile comprising:

a. a ballistic shape having a front end, a distal end, and a longitudinal bore in said distal end, said ballistic shape comprising i. a primary component having a specific gravity greater than lead; and ii. a binding component having a specific gravity less than lead;

iii. wherein said primary component and said binding component are cold-pressed together to form said ballistic shape;

b. a penetrator in said longitudinal bore of said ballistic shape;

c. an explosive charge proximate to said penetrator; and d. a detonator operatively connected with said explosive charge for igniting said explosive charge at a predetermined time, distance, or rotation of travel of said frangible projectile.

2. The self-destruct frangible projectile as in claim 1, wherein sad primary component comprises particles having a diameter between approximately 0.001 and 0.040 inches.

3. The self-destruct frangible projectile as in claim 1, wherein said frangible projectile has a specific gravity approximately equal to lead.

4. The self-destruct frangible projectile as in claim 1, further including a retainer cup in said longitudinal bore for receiving said explosive charge.

5. The self-destruct frangible projectile as in claim 1, wherein said detonator includes a timing mechanism for igniting said explosive charge at a predetermined time, distance, or rotation of travel of said frangible projectile.

6. The self-destruct frangible projectile as in claim 1, wherein said penetrator comprises a plurality of washers.

7. The self-destruct frangible projectile as in claim 6, wherein at least some of said washers are directly flush with one another.

8. The self-destruct frangible projectile as in claim 1, wherein said primary component comprises at least one of tungsten, tantalum, or tungsten-carbide.

9. The self-destruct frangible projectile as in claim 1, wherein said binding component comprises at least one of tin, aluminum, bismuth, copper, zinc, nylon, or polytetrafluoroethylene.

10. The self-destruct frangible projectile as in claim 1, further including a full-metal jacket surrounding said front end of said ballistic shape.

11. The self-destruct frangible projectile as in claim 1, further including a nose-piece proximate said front end of said ballistic shape.

12. A self-destruct frangible projectile comprising:

a. a ballistic shape having a front end, a distal end, and a longitudinal bore in said distal end, said ballistic shape comprising i. a primary component having a specific gravity greater than lead;

ii. a binding component having a specific gravity less than lead; and iii. a penetrator;

iv. wherein said primary component, said binding component, and said penetrator are cold-pressed together to form said ballistic shape;

b. an explosive charge in said longitudinal bore of said ballistic shape; and c. a detonator operatively connected with said explosive charge for igniting said explosive charge at a predetermined time, distance, or rotation of travel of said frangible projectile.

13. The self-destruct frangible projectile as in claim 12, wherein said primary component comprises particles having a diameter between approximately 0.001 and 0.040 inches.

14. The self-destruct frangible projectile as in claim 12, wherein said binding component comprises at least one of tin, aluminum, bismuth, copper, zinc, nylon, or polytetrafluoroethylene.

15. The self-destruct frangible projectile as in claim 12, further including a retainer cup in said longitudinal bore for receiving said explosive charge.

16. The self-destruct frangible projectile as in claim 12, wherein said detonator includes a timing mechanism for igniting said explosive charge at a predetermined time, distance, or rotation of travel of said frangible projectile.

17. The self-destruct frangible projectile as in claim 12, wherein said penetrator comprises a plurality of washers.

18. The self-destruct frangible projectile as in claim 17, wherein at least some of said washers are directly flush with one another.

19. The self-destruct frangible projectile as in claim 12, further including a full-metal jacket surrounding said front end of said ballistic shape.

20. The self-destruct frangible projectile as in claim 12, further including a nose-piece proximate said front end of said ballistic shape.

* * * * *